United States Patent [19]

Larson

[11] 4,147,610

[45] Apr. 3, 1979

[54] INDICATORS AND SHUTDOWN SYSTEM FOR PLATING

[76] Inventor: David W. Larson, 3224 N. 425 E., North Ogden, Utah 84404

[21] Appl. No.: 903,291

[22] Filed: May 3, 1978

[51] Int. Cl.[2] ..... C25D 17/00; C25F 3/02

[52] U.S. Cl. ..... 204/228; 204/129.2

[58] Field of Search ..... 204/228, 224 R, 224 M, 204/129.2

[56] References Cited

U.S. PATENT DOCUMENTS

| | | | |
|---|---|---|---|
| 2,494,121 | 1/1950 | Grainger | 204/228 X |
| 2,564,823 | 8/1951 | Wallace | 204/228 |
| 3,336,214 | 8/1967 | Cnota | 204/228 |
| 3,417,008 | 12/1968 | Koltuniak | 204/228 X |
| 3,496,087 | 2/1970 | Goodwin | 204/228 |

*Primary Examiner*—John H. Mack
*Assistant Examiner*—D. R. Valentine
*Attorney, Agent, or Firm*—Joseph E. Rusz; James S. Shannon

[57] ABSTRACT

An electrical apparatus for detecting improper operation in the electrolytic plating or etching of a workpiece. Three connections are made from the electrical detection circuit to the work area at the plating or etching tank, namely to the anode bus bar, the cathode bus bar, and the workpiece being processed. In the detection circuit are two polarity sensing devices, which in conjunction with other electrical and manual switching devices, indicators, timers and alarms can detect incorrect operation of the plating or etching process and notify the operator accordingly. Furthermore, in the case where the operator fails to respond to a warning indicator the apparatus disclosed automatically initiates shutdown of the process in operation. The use of three connections and an appropriately interconnected pair of polarity sensing devices notifies the operator when the electrical polarity at the workpiece is incorrect, when the workpiece is attached to the wrong bus bar, or when the time has elapsed in a short preparatory etch preceeding the plating process.

5 Claims, 2 Drawing Figures

INDICATORS AND SHUTDOWN SYSTEM FOR PLATING

RIGHTS OF THE GOVERNMENT

The invention described herein may be manufactured and used by or for the Government of the United States for all governmental purposes without the payment of any royalty.

BACKGROUND OF THE INVENTION

1. Field of the Invention

This invention relates to apparatus for electrolytically plating and etching metallic workpieces and more particularly to a means for detecting and responding to an inappropriate electrical polarity at the workpiece being processed.

2. Description of the Prior Art

The processes of electrolytic plating and etching are well known in the art, as are the standard pieces of equipment used to perform these processes. While the art is profuse with equipment design to provide large amounts of power and high speed detection of abnormal power flows, there appears to be a dearth of apparatus which is comparatively simple in design yet capable of detecting and responding to the day-to-day variety of wiring and operator errors. Superficially such problems may seem mundane and therefore easily corrected; nevertheless, they frequently appear and often destroy workpieces having a worth in the hundreds of thousands of dollars. A wiring error or part failure at the rectifying power supply, an accidental actuation of the reversal switch at the power supply, a connection of the workpiece to the wrong bus bar, and the failure of an operator to terminate a preparatory etch sequence in a timely manner are representative situations which have been encountered, and which, are specifically addressed and overcome by the invention described herein.

SUMMARY OF THE INVENTION

In accordance with this invention a pair of polarity sensing devices is connected to have the input leads of opposite polarity joined and electrically attached directly to the workpiece being plated or etched. The remaining input leads, one each from the two devices, are electrically connected with the remaining positive input attached to the anode bus bar and the remaining negative input attached to the cathode bus bar. The output response of each polarity sensing device is in the form of a center off single pole double throw switch whose throw direction is dependent upon the polarity across the input leads. Power is supplied to both of the switchable contacts in the outputs. The remaining four outputs from the devices are connected in pairs, with those representing opposite responses made common. Each of these common points is then attached to an indicator device representing the activation of either the plating or the etching processes.

When combined with timer devices and an automatic shutdown system the above circuit and devices indicates the process being performed, i.e. plating or etching, detects erroneous wiring or polarity settings at the rectifier power supply, detects whether the part is attached to the correct bus bar, and finally, is the foundation for an automated shutdown system to compensate for operator inattention.

DESCRIPTION OF THE PREFERRED EMBODIMENT

Figure 1:
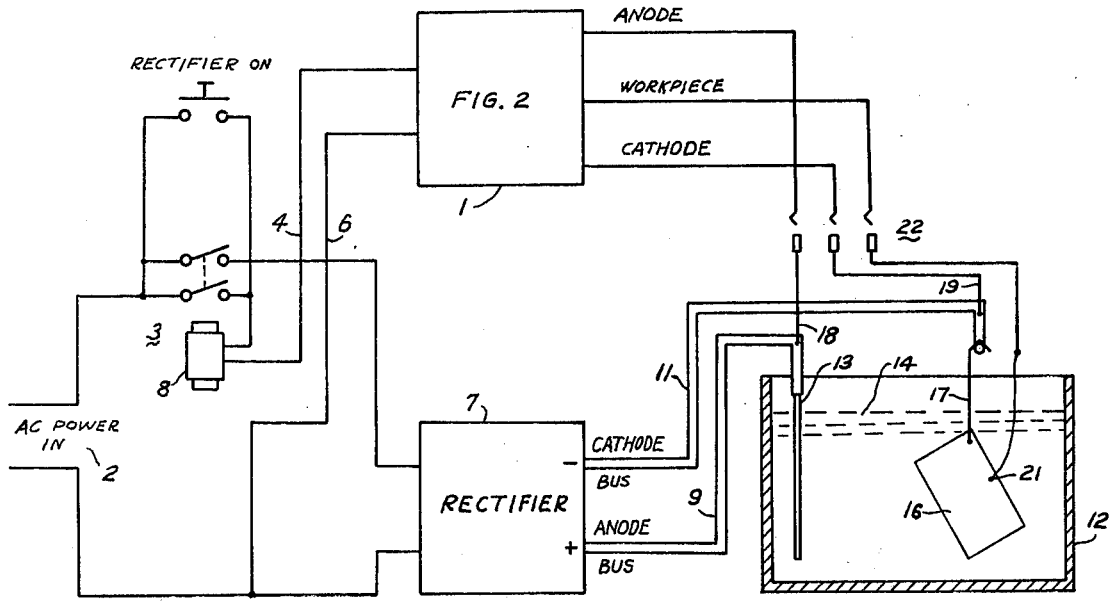
FIG. 1 is a schematic of the overall plating and etching system to which the invention pertains.
Figure 2:
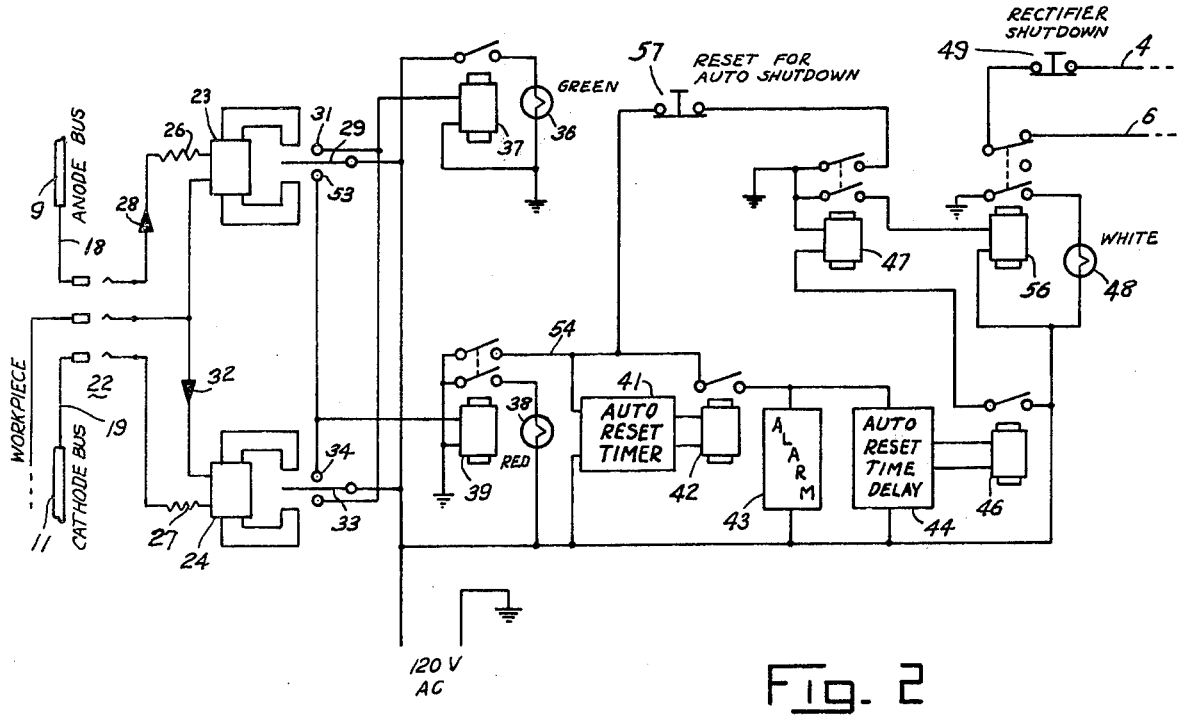
FIG. 2 shows one embodiment of the electrical circuit performing the functions claimed.

FIGS. 1 and 2 schematically represent one embodiment of the invention claimed. A general diagram of the complete system appears in FIG. 1, showing the sensing and control circuit in block 1 connected to the other elements which comprise the complete plating and etching system. FIG. 2 delineates the circuit elements contained in block 1 of FIG. 1.

For purposes of brevity, the use of the work "plating" as a modifier herein shall broadly encompass both plating and etching. This is in consonance with the primary objective of the apparatus depicted in FIGS. 1 and 2, in that etching when performed is primarily for purposes of cleaning or otherwise preparing the workpiece surfaces.

Electrical power is supplied in conventional fashion from fused AC source 2 through latching push-button and power relay combination 3. During normal operation lines 4 and 6 maintain continuity and thereby allow combination 3 to energize block 7, hereinafter referred to as rectifier block 7. It is readily apparent that a break in the continuity between lines 4 and 6 will deenergize power relay 8 and cease delivery of power to rectifier block 7.

Within rectifier block 7 are transformers, rectifiers, bus bar polarity reversers, and protective devices such as regulators or fuses, as is necessary to modify the AC power into a form of DC power compatible with the plating equipment and the workpiece. Anode bus bar 9 and cathode bus bar 11 conduct the plating current between rectifier block 7 and plating tank 12. A submersible element 13, comprised of a material such as lead, is attached at its upper end to anode bus bar 9 and extends downward well into electrolytic plating solution 14. The cathode bus bar, on the other hand, is usually in the form of a support from which workpiece 16 is suspended in the tank of plating solution 14 by means of conductive hanger 17. Since the means by which the bus bars are mated with the plating tank are of secondary importance to the substance of the invention, the structure depicted represently only the functional relationships of the elements described above.

The invention contemplates making three connections to the plating systems for sensing erroneous operations in the plating process. The remaining two leads between block 1 and the plating system, leads 4 and 6, provide the means for shutting down the plating process when prescribed conditions are not satisfied. Sensing connection 18 to anode bus bar 9, and sensing connection 19 to cathode bus bar 11, are preferably made in the immediate vicinity of plating tank 12. The third connection 21 is made directly to the workpiece. All three are routed through coded electrical connector 22 and into block 1.

The electrical circuit contained in block 1 of FIG. 1 is fully shown in FIG. 2. After passing through connector 22 the three sensing inputs are shown connected to the inputs of polarized relays 23 and 24. Resistors 26 and 27, appearing in the two bus bar sensing leads, are for the purpose of reducing the sensitivity in relays 23 and 24. Operationally, relay 23 responds such that current flow in direction 28 draws normally open contact 29 upward into a mate with contact 31. Reversing the direction of current flow reverses the direction of contact 29 travel. Similarly, current flow in direction 32 through relay 24 draws contact 33 upward to mate with contact 34.

Since the principal function for the system appearing in FIG. 1 is contemplated to be the plating process, illumination of green indicator light 36, operated by relay 37, is defined to notify the operator that plating is taking place. Illumination of red indicator light 38 by operation of relay 39 represents an outgoing etching operation. Automatic reset timer 41 is of a conventional design, commencing the timing operation upon being energized and resetting itself to zero upon the withdrawal of power. When the time specified lapses, timer 41 energizes relay 42 which applies power to alarm 43, such as a horn or bell, and time delay 44. Time delay 44 is again of a typical configuration, e.g. an automatically resetting thermal relay, wherein relay element 46, shown as a separate entity in FIG. 2, often comprises one segment of the time delay device.

White indicator light 48, when illuminated, informs the operator that the process has been shut down automatically by operation of the sensing circuit appearing in FIG. 2. Normally closed push button 49 provides the operator with the ability to manually shut down the ongoing process in the plating tank without energizing white indicator light 48.

The operation of the elements appearing in FIG. 1, with the exception of the circuit contained in block 1, are well known by those skilled in the art, and therefore, do not merit lengthy description. As noted above, leads 4 and 6 are shorted in block 1 during normal operation.

The operation of the circuit in FIG. 2 is best described in the context of the various operating modes, proper and otherwise, for which the design has been tailored. As noted hereinbefore, the prime objective of the system shown in FIG. 1 is to plate the workpiece, with occasional use of nominal preceeding etch to prepare the workpiece surfaces.

First, consider a proper plating sequence where the bus bars are of the correct polarity at tank 12, workpiece 16 is correctly mounted from cathode bus bar 11, and sensing connections 18, 19 and 21 are properly attached. The input leads to relay 24 are thereby shorted while current flow through relay 23 is in the direction depicted by arrow 28. Contact 29 of relay 23 is drawn to mate with contact 31, energizing relay 37 to illuminate green indicator light 36. The balance of the circuit remains inoperative.

As a second operating sequence consider the processing of a workpiece requiring a short preparatory etch of X minutes prior to undertaking the plating process. Again assume workpiece 16 is properly mated to cathode bus bar 11 and all sensing connections are attached. To etch the workpiece temporarily the operator reverses the bus bar connections in rectifier control panel 7. Current flow through relay 23 is now in a direction opposite that of arrow 28, drawing contact 29 to mate with contact 53 and thereby energize relay 39. With relay 39 energized power is applied to red indicator light 38 and automatic reset timer 41 by the grounding of line 54.

When the etching period prescribed by timer 41 has elapsed relay 42 energizes both alarm 43 and time delay 44. The alarm notifies the operator that the etching process should be terminated. If the operator fails to respond within the time period prescribed by time delay 44, relay 46 is energized to initiate automatic shutdown of the etching process before the workpiece is damaged. Relay 46 then energizes relay 47, latching timers 41 and 44, alarm 43, and relay 56 in the "on" state until the operator takes cognizance and actuates reset button 57. Upon being energized relay 56 opens the connection between leads 4 and 6, causing power relay 8 to deenergize and cease further power flow into rectifier block 7. The latching which energizes relay 56 also causes white indicator light 48 to be illuminated, informing the operator that the system has undergone an automatic shutdown.

The third operating sequence represents a situation where the reversal switch in rectifier block 7 is inadvertantly thrown while plating is properly in process. Normally, failure of the operator to take notice of such an incident in a reasonable period of time would result in the damage or destruction of the workpiece. With the presence of the circuit in FIG. 2, the system responds as if the operator intentionally commenced a preparatory etch sequence.

Two additional sequence are described herein. Though less likely to occur they have on occasion caused a workpiece to be destroyed. As the fourth of the sequences consider a wiring error in rectifier block 7, e.g. during equipment repair, causing a reversal of the bus bar polarity. The outcome here is no different than appearing in the third sequence, described above. The ability of the circuit to sense this error is linked to the location of the sensing attachment points 18, 19 and 21, in that the points are in the immediate location of the workpiece and thereby not obviated by preceeding wiring errors in rectifier block 7.

And finally the fifth sequence, wherein the workpiece is erroneously attached to the wrong bus bar at the plating tank. With the workpiece attached to anode bus bar 9 the inputs to relay 23 are shorted. Current now flows through relay 24 in the direction shown by arrow 32, moving contact 33 into a mate with contact 34. Once relay 39 is energized red indicator light 38 notifies the operator that the workpiece is being etched, and not plated as indicated by the switch settings. Again, failure of the operator to recognize the problem or respond thereto results in automatic shutdown before the workpiece is severly damaged.

If the operator inadvertently fails to mate sensing attachment 21 to workpiece 16 both green indicator light 36 and red indicator light 38 are illuminated, irrespective of the bus bar polarity.

I claim:

1. An electrical circuit for monitoring, displaying and controlling the processes in an electrolytic plating and etching system, comprising:

a. a first means responsive to the polarity of a voltage between its first and second input leads, for making connections between three output leads of the means, so that, zero voltage between the input leads produces no connection between any of the output leads, a positive voltage at the first input lead with respect to the second lead produces a connection between the first and the second output leads, and a negative voltage at the first input lead with respect to the second lead produces a connection between the first and the third output leads;

b. a second means responsive to the polarity of an electric voltage between its first and second input leads, for making connections between three output leads of the means, so that, zero voltage between the input leads produces no connection between any of the output leads, a positive voltage at the first input lead with respect to the second lead produces a connection between the first and the second output leads, and a negative voltage at the first input lead with respect to the second lead produces a connection between the first and the third output leads;

c. an electrical connection of the first input lead of the first means and the anode bus bar in the plating system;

d. an electrical connection of the second input lead of the second means and the cathode bus bar in the plating system;

e. an electrical connection of the second input of the first means, the first input of the second means, and a lead capable of being attached to a workpiece;

f. an electrical connection of the second output lead of the first means, the third output lead of the second means, and a means responsive to electric power for indicating that the workpiece is being plated;

g. an electrical connection of the third output lead of the first means, the second output lead of the second means, and a means responsive to electrical power for indicating that the workpiece is being etched.

2. The electrical circuit as recited in claim 1, wherein, the means responsive to electric power for indicating that the workpiece is being etched also energizes a timer, which timer further energizes an alarm and automatic shutdown system upon the lapse of a specified time period.

3. The electrical circuit as recited in claim 2, wherein, the automatic shutdown system contains another timer, which commences timing upon energizing of the alarm and shuts down the electrolytic plating and etching system at the completion of the time period.

4. The electrical circuit as recited in claim 3, wherein, the first and second means responsive to the polarity of an electric voltage between their input leads are polarized relays.

5. The electrical circuits as recited in claims 1, 2, 3, or 4, wherein, the electrical connections to the anode and cathode bus bars are in the immediate vicinity of the plating tank.

* * * * *